United States Patent [19]

Boyd, Jr.

[11] Patent Number: 4,564,824

[45] Date of Patent: Jan. 14, 1986

[54] ADJUSTABLE-PHASE-POWER DIVIDER APPARATUS

[75] Inventor: Charles R. Boyd, Jr., Arroyo Grande, Calif.

[73] Assignee: Microwave Applications Group, Santa Maria, Calif.

[21] Appl. No.: 595,437

[22] Filed: Mar. 30, 1984

[51] Int. Cl.[4] ..... H01P 5/12; H01P 1/17

[52] U.S. Cl. ..... 333/137; 333/21 A; 333/24.1

[58] Field of Search ..... 333/125, 137, 21 A, 333/24.1, 24.3

[56] References Cited

U.S. PATENT DOCUMENTS

| | | | |
|---|---|---|---|
| 2,438,119 | 3/1948 | Fox . | |
| 2,783,439 | 2/1957 | Whitehorn . | |
| 2,787,765 | 4/1957 | Fox | 333/21 A |
| 2,858,512 | 10/1958 | Barnett | 333/21 A X |
| 3,205,501 | 9/1965 | Kuhn . | |
| 3,474,454 | 10/1969 | Woermbke . | |
| 3,484,784 | 12/1969 | McLeod, Jr. . | |
| 3,510,675 | 5/1970 | Johnson et al. | 333/24.1 UX |
| 3,569,974 | 3/1971 | McLeod, Jr. . | |
| 3,626,335 | 12/1971 | Hord et al. | 333/21 A X |
| 3,698,008 | 10/1972 | Roberts et al. | 333/24.3 X |
| 3,736,535 | 5/1973 | Mohr et al. . | |
| 3,938,158 | 2/1976 | Birch et al. . | |
| 4,101,902 | 7/1978 | Trigon . | |
| 4,201,961 | 5/1980 | Klein | 333/21 A X |
| 4,443,800 | 4/1984 | Gaglione | 333/21 A X |
| 4,492,938 | 1/1985 | Young | 333/21 A X |

OTHER PUBLICATIONS

An article by the Inventor entitled, "Design of Ferrite Differential Phase Shift Sections," published in IEEE Cat. No. 75CH0955-5, May, 1975.

An article by Howard Scharfman entitled, "Three New Ferrite Phase Shifters," published in the Proceedings of the IRE, Oct. 1956, pp. 1456-1459.

A publication by the Assignee, Microwave Applications Group, entitled, *Basic Information on Dual-Mode Phase Shifters.*

*Primary Examiner*—Paul Gensler

*Attorney, Agent, or Firm*—Finnegan, Henderson, Farabow, Garrett & Dunner

[57] ABSTRACT

A phase-shifter apparatus which imposes a desired phase shift on an electromagnetic wave traveling through a waveguide, and divides the power in an output waveguide into two parts. The phase shifter apparatus includes a quarter-wave plate for changing the polarization of the linearly polarized wave to a circularly polarized wave, a rod of ferromagnetic material with a magnetic field for imposing a desired phase shift on the circularly polarized wave traveling through the rod, a quarter-wave plate for converting the circularly polarized wave to a linearly polarized wave, and a septum polarizer in the output wave guide for dividing the power. The output waveguide has the power divided between two ports, and independent phase shifts are imposed on the electromagnetic waves of each port.

21 Claims, 3 Drawing Figures

ADJUSTABLE-PHASE-POWER DIVIDER APPARATUS

BACKGROUND OF THE INVENTION

This invention relates to guided electromagnetic wave transmission systems, and more particularly to phase changing and power dividing apparatus used in such systems.

DESCRIPTION OF THE PRIOR ART

Ferrite phase shifters find application, for example, in the control of the pointing direction of a phased array antenna. A phased array antenna comprises a number of individual radiating elements. The pointing direction of the array is determined by the relative phase of the electromagnetic energy coupled to each individual radiating element. Control of such phase can be performed with a ferrite phase shifter.

The pointing direction of the resultant antenna beam is dependent on the relative phase of energy coupled to the radiating elements. Command signals allow rapid change of the relative phase of energy coupled to the radiating elements driven by different phase shifters. The spatial distribution and phase control of the radiating elements may be arranged to permit scanning in a single angular direction (e.g. azimuth or elevation) or to permit simultaneous selection of beam pointing direction in each of two angular directions (e.g. azimuth and elevation). In the case of scanning in two directions, it is generally necessary to set the phase angle uniquely at each radiating element in order to attain high performance levels over wide scan angles. It is also desirable to maintain differences in amplitude of the radiated signal from elements at different locations in the antenna array. For these reasons, prior high performance, two direction scanning phased-array antennas have required the use of one phase shifter per radiating element to provide the necessary phase differences, with necessary amplitude differences established by a power distribution scheme.

A reciprocal ferrite phase shifter typically converts a linearly polarized electromagnetic wave to a circularly polarized wave, and subsequently converts the circularly polarized wave back to a linearly polarized wave. While the electromagnetic wave is in the circularly polarized state the desired phase shift is imposed by means of magnetic bias fields. This phase shift appears in the electromagnetic wave when it is subsequently converted to a linearly polarized wave. Devices used to change polarization and impose a desired phase shift typically comprise a quarter-wave plate and the half-wave plate, respectively.

More specifically, certain types of ferrite phase shifters convert incident linearly polarized microwave signals to circularly polarized waves, which are controlled to provide the desired phase shift characteristics by means of magnetic bias fields imposed in the ferrite from external circuits, and which are subsequently converted back to linearly polarized signals and coupled to the device output. One such type is the device described in U.S. Pat. No. 3,698,008 in which the variable phase shift results from control of a longitudinal magnetic bias field in the region where a circularly polarized wave propagates. This phase shifter type will be herein designated as a "dual-mode" type device. A second such type is the device described in U.S. Pat. No. 2,787,765 in which the variable phase shift results from rotation of a transverse magnetic bias field that establishes a half-wave plate characteristic located between fixed quarter-wave plates. This phase shifter type will be herein designated as a "rotary-field" type device.

Various enhancements to the dual-mode phase shifter have been offered, such as those described in U.S. Pat. No. 3,698,008 and U.S. Pat. No. 3,736,535. These enhancements involve modifications and additions to the basic phase shifter structure to effect changes of the polarization transmitted and received by the phase shifter. Variations to the rotary-field phase shifter have also been offered, such as that described in U.S. Pat. No. 4,201,961. The main objective has been to achieve unidirectional phase shift and other non-reciprocal characteristics. In the prior art, quarter-wave plates of fixed angular orientation are used and the phase shifter output waves are coupled to a single waveguide or radiating element. Such prior art devices do not provide for a phase shifter which can drive, for example, two radiating elements with a different phase and amplitude for each element.

SUMMARY OF THE INVENTION

It is an object of the present invention to provide a single phase shifter having two outputs and in which the differential phase angle between the two outputs is controlled independently of the absolute phase shift of either output.

It is another object of the present invention to provide a phase shifter having a single input and two outputs with the power of an electromagnetic wave incident on the input selectively divided between the output waveguides.

It is a further object of the present invention to provide a phase shifter apparatus which has an input and two outputs, in which the power of an incident electromagnetic wave from the input is selectively divided between the two outputs, and in which electromagnetic waves at the two outputs have a selectable differential phase angle with respect to each other and have an independently selectable phase angle with respect to the input electromagnetic wave.

According to the present invention, is embodied and broadly described herein, an adjustable-phase power divider is provided comprising a first quarter-wave plate, a variable phase section coupled to the first quarter-wave plate, a second rotatable quarter-wave plate coupled to the variable phase section and a septum polarizer coupled to the rotatable quarter-wave plate. In a first species of the subject invention, the quarter-wave plate includes a fixed magnetic quarter-wave plate which, for example, can be a non-reciprocable ferrite fixed quarter-wave plate; the variable phase section includes means for establishing a variable longitudinal magnetic bias field in the region of the variable phase section, and, for example, can be a latching ferrite, and the second rotatable quarter-wave plate includes a rotatable magnetic quarter-wave plate which can be embodied as a non-reciprocal ferrite rotatable quarter-wave plate.

According to a second species of the present invention, the first quarter-wave plate includes a fixed ceramic dielectric quarter-wave plate; the second quarter-wave plate includes a rotatable non-reciprocal quarter-wave plate; the variable phase section includes means for establishing a rotatable transverse magnetic bias field in the region of the variable phase section, which field establishes a half-wave plate characteristic, and this section may, for example, include a rotatable non-reciprocal half-wave plate; and in addition this second species further includes a 45 degree Faraday rotator between the second quarter-wave plate and the septum polarizer, which can, for example, comprise a reciprocal fixed permanent magnet 45 degree rotator.

The present invention may also be viewed as including an adjustable-phase power divider comprising first means for converting a linear electromagnetic wave to a circularly polarized electromagnetic wave, second means for varying the phase of the circularly polarized electromagnetic wave, third means for converting the circularly polarized electromagnetic wave to a linearly polarized electromagnetic wave aligned at a selectably adjustable angle, and fourth means for dividing the selectably aligned electromagnetic wave into its circularly polarized components as a function of the adjustable angle. In one species, the first and third means for converting include non-reciprocal means; and the second means for varying includes a latching ferrite. In an alternative species the first means is reciprocal; the second means comprises a rotatable magnetic half-wave plate; the third means is non-reciprocal; and the adjustable-phase power divider includes a fifth means located between the third and fourth means for rotating the selectably aligned electromagnetic wave 45 degrees. This fifth means preferably includes a non-reciprocal ferrite. In either species, the fourth means preferably comprises a septum polarizer.

Additional objects and advantages of the invention will be set forth in part in the description which follows, and in part will be obvious from the description, or may be learned by practice of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
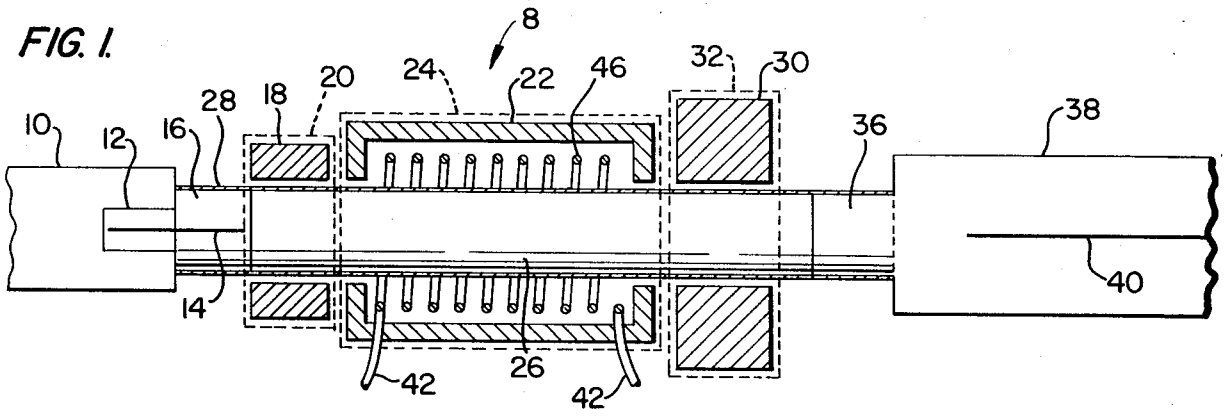
FIG. 1 is a block diagrammatic view of a first embodiment of a variable phase shifter power divider constructed according to the present invention.

Referring to FIG. 1, a preferred embodiment of a longitudinal-field phase shifter apparatus 8 is shown comprising an input waveguide 10, coupling section 12, resistive film layer 14, and ceramic coupling section 16. Input waveguide 10 couples a linearly polarized electromagnetic wave to phase shifter apparatus 8 through coupling section 12 which serves partially to match impedance between input waveguide 10 and phase shifter apparatus 8 and partially to absorb any cross-polarized reflected waves. Coupling section 12 couples a first linearly polarized electromagnetic wave from input waveguide 10 to phase shifter apparatus 8. As is well-known to those skilled in the art, coupling section 12 may include a resistive film layer 14 sandwiched between sections of coupling section 12 and sections of ceramic coupling section 16. Coupling section 16 is attached to coupling section 12 and effects maximum power transfer between input waveguide 10 and phase shifter apparatus 8.

A fixed quarter-wave plate 20 converts the input, linearly polarized, electromagnetic wave to a circularly polarized electromagnetic wave. As illustrated in FIG. 1, a nonreciprocal quarter-wave plate 20 may include a fixed magnetic quarter-wave plate having a solid cylindrical rod of ferrimagnetic material 26 encircled at one portion by a permanent magnet structure 18. Solid cylindrical ferrite rod 26 extends the length of phase shifter apparatus 8, between coupling section 16 and coupling section 36 which will described below. A variable phase section 24 imposes the desired phase shift on the circularly polarized electromagnetic wave passing through phase shifter apparatus 8. As illustrated in FIG. 1, variable phase section 24 may include means for establishing a variable longitudinal field within a portion of cylindrical ferrite rod 26. This longitudinal magnetic field is induced by a coil 46 controlled by a current applied at terminals 42. This longitudinal field is provided a return path through yoke 22. Variable phase section 24 may comprise a latching ferrite.

Shielding 28 for ferrite rod 26 may, for example, comprise a conductive layer. Shielding 28 extends the entire length of ferrite rod 26 and connects to waveguides 10 and 38, to establish the outer wall of a waveguide about rod 26.

In accordance with the present invention there is provided means for converting a circularly polarized electromagnetic wave to a linear electromagnetic wave which, most importantly, is aligned at a selectably adjustable angle. This adjustment of this angle is totally independent of the phase shift imparted to the circularly polarized wave.

As illustratively shown in FIG. 1 by way of example and not limitation, a second nonreciprocal quarter-wave plate 32 is shown which includes a rotatable magnetic quarter-wave plate. The rotatable magnetic quarter-wave plate is a significant modification of dual-mode phase shifters, since this rotation allows the plane of polarization of the signal traveling from left to right in FIG. 1 to be selectively rotated to an arbitrary angle. Rotatable magnetic quarter-wave plate 32 includes the aforementioned ferrite rod 26 which is encircled by an electromagnetic yoke 30. Rotatable magnetic quarter-wave plate 32 transforms circularly polarized electromagnetic waves in variable phase section 24 to a linearly polarized electromagnetic wave, with this electromagnetic wave retaining the phase shift imposed on it from section 24, and with the orientation of the resultant linearly polarized wave being selectably independent of this phase shift.

Ceramic coupling section 36 is attached to one end of ferrite rod 26, and effects maximum power transfer between rotatable magnetic quarter-wave plate 32 and output waveguide 38.

Septum polarizer 40 is formed at output waveguide 38 and may be dielectric filled. Septum polarizer 40 divides the selectably aligned electromagnetic wave from rotatable magnetic quarter-wave plate 32 into circularly polarized components as a function of the adjustable angle of that wave. Thus, if the wave from quarter-wave plate 32 is perfectly linear, septum polarizer effects an even power split of that incident wave, with the phase of each of the two output electromagnetic waves being different. The relative phase difference between the two output electromagnetic waves depends on the orientation of the linearly polarized incident wave relative to the plane of the tapered or stepped fin of septum polarizer 40. In other words, the relative phase difference between the two output waves is dependent on the adjustable angle of the incident wave created by operation of rotatable magnetic quarter-wave plate 32. However, as will be more fully explained below, the relative phase difference between either output wave and the wave incident to apparatus 8 may be independently adjusted by operation of variable phase section 24. Thus, complete dependent adjustment of the two output waves may be achieved.

Moreover, if rotatable magnetic quarter-wave plate 32 is operated, as should be fully understood by those skilled in the art, to provide less than complete linear polarization of the circularly polarized wave in section 24, the two outputs of septum polarizer 40 are uneven as a function of the degree of circular polarization remaining in the wave incident to septum polarizer 40, as is also described in more detail below.

The action of quarter-wave plates and half-wave plates upon electromagnetic waves propagating through phase shifter apparatus is described and explained, for example, by Fox in U.S. Pat. No. 2,438,119, which is expressly incorporated herein by reference. The effect of ferrite quarter-wave plates and ferrite half-wave plates, in particular, is discussed by Fox in U.S. Pat. No. 2,787,765, which is expressly incorporated herein by reference. A quarter-wave plate, in general, is effective to convert linearly polarized electromagnetic energy propagating therethrough in either direction into a circularly polarized electromagnetic wave. Half-wave plates, in general, are effective to reverse the sense of circularly polarized electromagnetic energy propagating therethrough in either direction, for example, from right circularly polarized energy to left circularly polarized energy, and to change the phase of the electromagnetic energy propagating therethrough as a function of the angular rotation of the half-wave plate relative to the fixed quarter-wave plates. Such phase change referred to throughout the description of the operation of the present invention is in addition to the inherent insertion phase characteristics of the total phase shifter apparatus introduced by fixed magnetic quarter-wave plate 20, longitudinal variable phase section 24 and rotatable magnetic quarter-wave plate 32. The input and output waveguides 10 and 38, respectively, function to support only linearly polarized electromagnetic waves.

Figure 2:
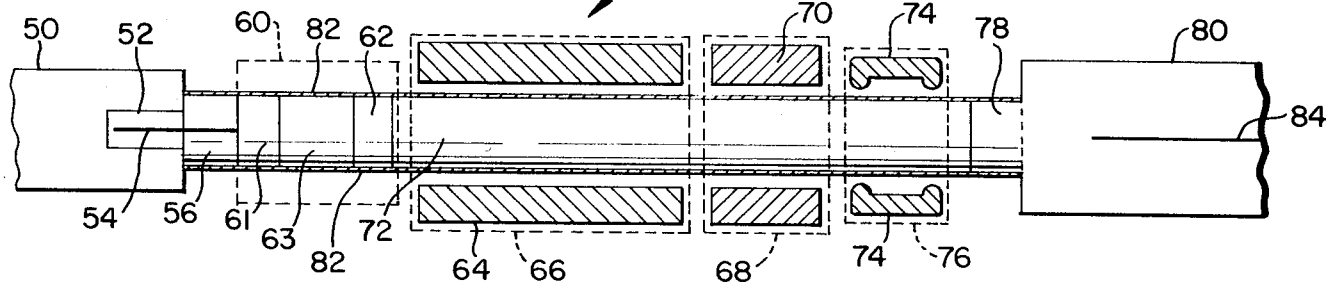
FIG. 2 is a block diagrammatic view of a second embodiment of a variable phase shifter power divider constructed according to the present invention.

FIG. 2 shows a preferred embodiment of phase shifter apparatus 51 which includes an input wave guide 50, coupling section 52, resistive film layer 54, and coupling section 56. Input waveguide 50 couples a linearly polarized electromagnetic wave to the phase shifter apparatus 51. Coupling section 52 serves partially to match impedance of the input waveguide 50 and phase shifter apparatus 51 and partially to absorb any cross-polarized reflected waves. Coupling section 52 couples a linearly polarized electromagnetic wave from input waveguide 50 to phase shifter apparatus 51. Coupling section 52 includes a resistive film layer 54 sandwiched between sections of coupling section 52 and between sections of coupling section 56. Coupling section 56 which is attached to coupling section 52, effects maximum power transfer between input waveguide 50 and phase shifter apparatus 51.

A reciprocal fixed dielectric quarter-wave plate 60 is illustrated in FIG. 2 which changes the polarization of the input linearly polarized electromagnetic wave to that of a circularly polarized electromagnetic wave. Impedance matching section 61 of the dielectric quarter-wave plate 60 effects maximum power transfer between coupling section 56 and the dielectric differential phase section 63 of the dielectric quarter-wave plate 60. Ceramic matching section 62 of the dielectric quarter-wave plate 60 effects maximum power transfer between dielectric differential phase section 63 of the dielectric quarter-wave plate 60 and ferrite rod 72. Ferrite rod 72 extends the length of phase shifter apparatus 51, between matching section 62 and matching section 78 described below.

A rotary field variable phase section 66 is provided in apparatus 51 of FIG. 2 which imposes the desired phase shift on the circularly polarized electromagnetic wave from quarter-wave plate 60 and changes the sense of polarization, for example, from right circularly polarized electromagnetic wave to that of a left circularly polarized electromagnetic wave. Rotatable magnetic half-wave plate 66 is connected to matching section 62.

In accordance with the present invention there is provided means for converting a circularly polarized electromagnetic wave to a linear electromagnetic wave with a plane of polarization which, most importantly, is aligned at an independently adjustable angle. This wave is then preferably rotated an additional 45 degrees in a nonreciprocal Faraday rotator.

For example, as illustratively shown in FIG. 2 rotatable magnetic half-wave plate 66 is connected to a nonreciprocal rotatable magnetic quarter-wave plate 68. Rotatable magnetic quarter-wave plate 68 includes ferrite rod 72 encircled by an electromagnetic yoke 70. Rotatable quarter-wave plate 68 converts the circularly polarized electromagnetic wave in rotary field variable phase section 66 to that of a linearly polarized electromagnetic wave. Rotatable magnetic quarter-wave plate 68 is in turn coupled to nonreciprocal, fixed permanent magnet rotator 76 which imposes a 45-degree nonreciprocal rotation of the plane of polarization of the linearly polarized electromagnetic wave from quarter-wave plate 68. Faraday rotator 76 includes rod 72 encircled by a permanent magnet 74 producing an axial magnetic field in the adjacent portion of rod 72.

Matching section 78 is provided to effect maximum power transfer between rod 72 and output waveguide 80. As embodied herein, matching section 78 includes one or more quarter-wave sections having characteristic impedances in particular ratios to the impedance of rod 72 and output waveguide 80. Conductive layer 82 encircles ferrite rod 72 to form the outer wall of a waveguide. Septum polarizer 84 effects an even power split for linearly polarized electromagnetic waves incident from matching section 78.

Figure 3:
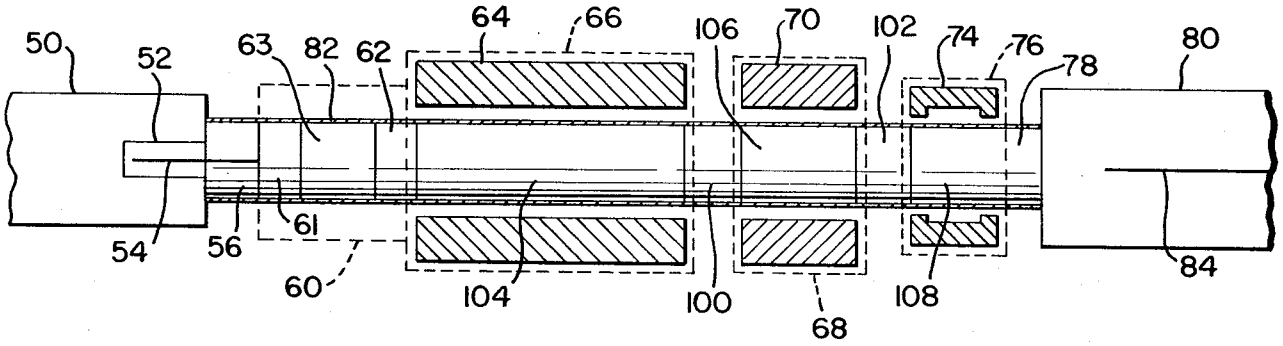
FIG. 3 is a block diagrammatic view of an alternate form of the second embodiment of a variable phase shifter power divider constructed according to the present invention.

An alternative embodiment of a variable phase shifter and power divider of FIG. 2 is depicted in FIG. 3. Like parts are numbered as in FIG. 2. The structure of FIG. 3 is distinguished from the structure of FIG. 2 in that optional ceramic spacers 100 and 102 can be inserted between sections of ferrite rod 106. Ferrite rod may comprise sections 104, 106 and 108. Conductive layer 82 encircles rod sections 104, 106, and 108; first and second ceramic spacers 100 and 102; fixed dielectric quarter-wave plate 60; and coupling section 56 and matching sections 62 and 78 so as to form the outer wall of a waveguide.

The present invention of a power divider with an adjustable phase and amplitude includes a dual-mode ferrite phase shifter as illustrated by way of example in FIG. 1 and rotary-field ferrite phase shifter as illustrated by way of example in FIGS. 2 and 3. This invention allows a single structure to drive two radiating elements with signals of arbitrary phase and differential amplitude, and in comparison with the prior art, this permits the number of phase shifter devices to be reduced by one half for the same number of antenna elements.

In both the dual-mode phase shifter embodiment and the rotary-field phase shifter embodiment of this invention, the wave incident on the output quarter-wave plate ideally has perfect circular polarization. The properties of the output quarter-wave plate are such that the incident, circularly polarized wave is converted to a linearly polarized wave. The orientation of this linearly polarized wave is in one-to-one correspondence with the orientation of the principal axes of the output quarter-wave plate. Thus, when the principal axes of the rotatable quarter-wave plate are turned through a particular angle, the plane of polarization of the linearly polarized wave will turn through the same angle. This angle, in part, determines the differential phase angle between the two output electromagnetic waves.

The septum polarizers 40 and 84 in FIGS. 1, 2 and 3 have characteristics such that linearly polarized energy applied to a square or circular waveguide input will divide evenly in power between two rectangular waveguide outputs, because the phase difference between the two outputs will vary at twice the value at which the angle of the plane of polarization of the input wave varies. For example, a rotation of 90-degrees in the plane of polarization of the incident linear wave will change the relative phase of the two equal-amplitude output waves by 180-degrees. These changes in differential phase angle will be effected by turning the principal axis of the rotatable quarter-wave plate through an appropriate angle.

It is well known that the phase-angle determination for a circularly polarized wave changes in one-to-one correspondence with rotation of the measurement reference plane. Because of this phenomenon, electrically turning of the rotatable quarter-wave plate has the effect of changing the insertion phase of the phase shifter itself. When the rotatable quarter-wave plate is turned through a particular angle, the insertion phase of the phase shifter will increase or decrease by the same angle value, the direction of variation depending on the sense, i.e., right or left circular polarization, of the circularly polarized wave incident from the variable-phase section to the quarter-wave plate section. The change of insertion phase angle produced by this phenomenon uniformly affects both outputs from the septum polarizer. The net effect is that for turning the rotatable quarter-wave plate through a particular angle, the total insertion phase is ideally unchanged for one of the septum polarizer outputs, while the other output experiences a change of phase angle equal in magnitude to an angle twice as great as the turning angle of the rotatable quarter-wave plate.

In the case of the power divider using a rotary-field phase shifter with the added means for inducing a 45-degree Faraday rotation by device 76 of FIGS. 2 and 3, the septum polarizer output waveguide having no change of insertion phase in one direction of transmission when the rotatable quarter-wave plate is turned, will also have no change in the other direction of transmission. The insertion phase characteristics of this power divider type, therefore, will be reciprocal, neglecting constant non-reciprocal amounts. For a power divider using a dual-mode phase shifter configuration, the septum polarizer ports with insertion phase unaffected by turning of the rotatable quarter-wave plate will be different for the two directions of propagation. This condition results from the fact that the sense of circular polarization in the variable-phase region of the dual-mode phase shifter is opposite for the two propagation directions. As a consequence, a non-reciprocal insertion phase amount, dependent on the orientation of the principal axes of the rotatable quarter-wave plate, will exist for the power divider using a dual-mode phase shifter configuration. This characteristic can be acceptable for use in a phased-array antenna in which the adjacent-element phase difference is uniform over the entire array. In this case, the nonreciprocal insertion phase will be the same for all power dividers and the antenna patterns for the transmitting and receiving will be identical.

In order to produce a difference of amplitude between the septum polarizer output waveguides, it is only necessary to vary the value of insertion phase difference along the principal axes of the rotatable quarter-wave plate. In the nominal case, an insertion phase difference of 90-degrees is chosen, and this choice produces a linearly polarized wave, with equal power division by the septum polarizer, when a circularly polarized wave is incident from the variable-phase section. By adjusting the phase difference away from 90-degrees, an elliptically polarized wave will be produced at the input to the septum polarizer instead of a linearly polarized wave. The septum polarizer will act on the elliptically polarized wave to produce an amplitude imbalance between the two outputs, with the direction of imbalance dependent on the sense, i.e., right or left circular polarization, of the ellipticity and the amount of the imbalance dependent on the degree of ellipticity. Phase relations as presented above will be preserved, where the orientation of the major axes of the ellipse has the same effect as the orientation of the plane of polarization of the linearly polarized wave.

It will be apparent to those skilled in the art that various modifications can be made to the adjustable-phase power divider apparatus of the instant invention without departing from the scope or spirit of the invention, and it is intended that the present invention cover modifications and variations of the system provided they come within the scope of the appended claims and their equivalents.

What is claimed is:

1. A waveguide transmission line adjustable-phase power divider comprising:

(a) a first quarter-wave plate;

(b) a variable phase section coupled to said first quarter-wave plate;

(c) a second rotatable quarter-wave plate coupled to said variable phase section; and (d) a septum polarizer coupled to said second rotatable quarter-wave plate.

2. An adjustable-phase power divider of claim 1 wherein:

(a) said first quarter-wave plate comprises a fixed magnetic quarter-wave plate; and (b) said second quarter-wave plate comprises a rotatable magnetic quarter-wave plate.

3. An adjustable-phase power divider of claim 1 wherein:

(a) said first quarter-wave plate comprises a nonreciprocal ferrite fixed quarter-wave plate; and (b) said second quarter-wave plate comprises a nonreciprocal ferrite rotatable quarter-wave plate.

4. An adjustable-phase power divider of claim 1, 2 or 3 wherein said variable phase section comprises means for establishing a variable longitudinal magnetic bias field in the region of said variable phase section.

5. An adjustable-phase power divider of claim 4 wherein said variable phase section comprises a latching ferrite.

6. An adjustable-phase power divider of claim 1 wherein:

(a) said first quarter-wave plate comprises a fixed ceramic dielectric quarter-wave plate;

(b) said second quarter-wave plate comprises a rotatable magnetic quarter-wave plate; and wherein said divider further comprises a 45 degree Faraday rotator between said second quarter-wave plate and said septum polarizer.

7. An adjustable-phase power divider of claim 1 wherein:

(a) said first quarter-wave plate comprises a fixed reciprocal quarter-wave plate;

(b) said second quarter-wave plate comprises a rotatable nonreciprocal quarter-wave plate; and wherein said divider further comprises a nonreciprocal 45 degree Faraday rotator between said second quarter-wave plate and said septum polarizer.

8. An adjustable-phase power divider of claim 1, 6 or 7 wherein said variable phase section comprises means for establishing a rotatable transverse magnetic bias field in the region of said variable phase section, which field establishes a half-wave plate characteristic.

9. An adjustable-phase power divider of claim 8 wherein said variable phase section comprises a rotatable nonreciprocal half-wave plate.

10. An adjustable-phase power divider of claim 6 or 7 wherein 45 degree Faraday rotator comprises a fixed permanent magnet.

11. A waveguide transmission line adjustable-phase power divider comprising:

(a) first means for converting a linear electromagnetic wave to a circularly polarized electromagnetic wave;

(b) second means for varying the phase of said circularly polarized electromagnetic wave;

(c) third means for converting said circularly polarized electromagnetic wave to a linear electromagnetic wave aligned at a selectably adjustable angle; and (d) fourth means for dividing said selectably aligned electromagnetic wave into its circularly polarized components as a function of said adjustable angle.

12. An adjustable-phase power divider of claim 11 wherein said first and third means are non-reciprocal.

13. An adjustable-phase power divider of claim 12 wherein said second means comprises a latching ferrite.

14. An adjustable-phase power divider of claim 11, 12 or 13 wherein said second means comprises a longitudinal-field variable phase section.

15. An adjustable-phase power divider of claim 14 wherein said fourth means comprises a septum polarizer.

16. An adjustable-phase power divider of claim 11 wherein said first means is reciprocal and said third means is non-reciprocal.

17. An adjustable-phase power divider of claim 16 wherein said second means comprises a rotatable magnetic half-wave plate.

18. An adjustable-phase power divider of claim 16 wherein said second means comprises a rotary field variable phase section.

19. An adjustable-phase power divider of claim 11, 16 or 17 further comprising fifth means located between said third and fourth means for rotating said selectably aligned electromagnetic wave 45 degrees.

20. An adjustable-phase power divider of claim 19 wherein said fifth means comprises a nonreciprocal ferrite.

21. An adjustable-phase power divider of claim 20 wherein said fourth means comprises a septum polarizer.

* * * * *